US006729147B2

(12) United States Patent
Lee

(10) Patent No.: US 6,729,147 B2
(45) Date of Patent: May 4, 2004

(54) APPARATUS AND METHOD FOR CONTROLLING OPERATION OF COMPRESSOR IN REFRIGERATOR

(75) Inventor: Won-Woo Lee, Gimhae (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/407,210

(22) Filed: Apr. 7, 2003

(65) Prior Publication Data

US 2003/0209019 A1 Nov. 13, 2003

(30) Foreign Application Priority Data

May 7, 2002 (KR) ..... 10-2002-0025124

(51) Int. Cl.[7] ..... F25B 49/00
(52) U.S. Cl. ..... 62/131; 62/231
(58) Field of Search ..... 62/131, 186, 207, 62/226, 230, 231

(56) References Cited

U.S. PATENT DOCUMENTS 5,678,416 A * 10/1997 Yoo et al. ..... 62/180
5,887,443 A * 3/1999 Lee et al. ..... 62/153
6,014,865 A * 1/2000 Kim et al. ..... 62/151
6,058,722 A * 5/2000 Choi ..... 62/131

FOREIGN PATENT DOCUMENTS

JP 362288443 A * 12/1987
JP 363014029 A * 1/1988
JP 63135743 A * 6/1988
JP 02000081264 A * 3/2000
JP 02000329431 A * 11/2000
JP 02002267339 A * 9/2002
JP 2003148847 A * 5/2003

* cited by examiner

*Primary Examiner*—William E. Tapolcai
*Assistant Examiner*—Mohammad M. Ali
(74) *Attorney, Agent, or Firm*—Fleshner & Kim, LLP

(57) ABSTRACT

An apparatus and a method for controlling operation of a compressor in a refrigerator, which are able to prevent an explosion of refrigerant caused by leakage of the refrigerant by supplying or blocking power source to electric devices in the refrigerator after detecting error of the compressor, comprise a temperature sensing unit for sensing inner temperature of the refrigerator, a door open sensing unit for sensing opened/closed status of the refrigerator door, an operating time measuring unit measuring operating time of the compressor, a microcomputer outputting a control signal based on the inner temperature, opened/closed status of the door and the operating time of the compressor, and a driving unit for supplying or blocking power source to all electric devices in the refrigerator based on the control signal.

34 Claims, 5 Drawing Sheets

APPARATUS AND METHOD FOR CONTROLLING OPERATION OF COMPRESSOR IN REFRIGERATOR

BACKGROUND OF THE INVENTION

1. Field of the Invention

The present invention relates to a compressor of a refrigerator, and particularly, to an apparatus and a method for controlling operation of a compressor in a refrigerator which are able to control the driving of refrigerator compressor by detecting whether there is an error in the compressor of the refrigerator.

2. Description of the Background Art

Generally, a refrigerator uses a vapor compression refrigeration method that freezes by repeating vaporization and condensation of a refrigerant which can be evaporated easily under a pressure similar to atmospheric pressure. Also, freon gas is widely used as the refrigerant used in the refrigerator. However, since the freon gas is one of elements destructing ozone layer, new substituting solvents are under development and R600a refrigerant is one of the new solvents. The R600a refrigerant is an environment-friendly refrigerant having 0 ozone depletion potential and 0 global warming potential, and has advantages such that injection amount is less than that of conventional refrigerant, cost for changing existing equipment and machines is less than that of conventional refrigerant, and noise generation can be reduced. Brief construction of the general refrigerator will be described with reference to FIG. 1.

FIG. 1 is a block diagram showing a brief construction of the general refrigerator.

As shown therein, the refrigerator comprises: a power source unit 100 for supplying power source; a cooling chamber 110 for storing foods in low temperature; a freezing chamber 120 for storing foods in frozen status; refrigerator doors 200 installed on front surfaces of the cooling chamber 110 and the freezing chamber 120 and used when a user stores the foods or draws the stored foods; a temperature sensing unit 700 for sensing inner temperatures of the cooling chamber 110 and the freezing chamber 120 using a temperatures sensor 10; a micro computer 600 for outputting a control signal based on the temperature sensed by the temperature sensing unit 700 and based on the predetermined temperature by the user; a compressor 400 for generating refrigerant; and a driving unit 500 for supplying or blocking the power source to the compressor 400 in order to control a fan motor 300 and the compressor 400 based on the control signal outputted from the microcomputer 600.

FIG. 2 is an operational flow chart illustrating a method for controlling operation of the compressor in the refrigerator according to the conventional art.

As shown therein, the operation controlling method according to the conventional art comprises: a step of sensing inner temperatures in the cooling chamber 110 and the freezing chamber 120 when the user selects operational mode of the refrigerator (S20); a step of comparing the inner temperatures of the cooling chamber 110 and the freezing chamber 120 sensed by the temperature sensing unit 700 to the predetermined temperature by the user (S21); a step of supplying power source to the compressor 400 in order to drive the compressor 400 when the inner temperatures of the cooling chamber 110 and the freezing chamber 120 are higher than the predetermined temperature (S22); and a step of blocking the power source supplied to the compressor 400 in order to suspend the driving of compressor 400 when the inner temperatures of the cooling chamber 110 and the freezing chamber 120 are lower than the predetermined temperature (S23).

The operation controlling method for the compressor of refrigerator according to the conventional art will be described in detail as follows. When the user selects the operational mode of the refrigerator, the temperature sensing unit 700 senses the inner temperatures of the cooling chamber 110 and the freezing chamber 120 and outputs the sensed temperature information to the microcomputer 600. Herein, the temperature sensing unit 700 senses the temperatures of the cooling chamber 110 and the freezing chamber 120 continuously, and outputs the changed temperature information to the microcomputer 600 whenever the sensed temperature is changed (S20).

The microcomputer 600 outputs a control signal to the driving unit 500 based on the temperatures sensed by the temperature sensing unit 700 and the predetermined temperature. Herein, when the temperatures sensed by the temperature sensing unit 700 is higher than the predetermined temperature, a first control signal for supplying the power source to the compressor 400 is outputted, and when the temperatures sensed by the temperature sensing unit 700 are lowered than the predetermined temperature, a second control signal for blocking the power source supplied to the compressor 400 is outputted (S21).

The driving unit 500 supplies or blocks the power source to the compressor 400 based on the first and second control signals outputted from the microcomputer 600 in order to control the compressor 400. Herein, the driving unit 500 receives the first control signal and supplies the power source 100 to the compressor 400 in order to drive the compressor continuously (S22). On the other hand, the driving unit 500 receives the second control signal and blocks the power source supplied to the compressor 400 in order to suspend the compressor 400.

Therefore, the method for controlling operation of the compressor in the refrigerator according to the conventional art outputs the control signal based on the temperature sensed by the temperature sensing unit 700 and the predetermined temperature, and therefore, the driving unit 500 controls the operation of compressor 400 based on the control signal of the microcomputer 600. As a result, the inner temperatures of the cooling chamber 110 and the freezing chamber 120 can be maintained to be lower than the predetermined temperature always. Generally, the compressor of the refrigerator is operated with turning on/off period of 0.1~10 times per hour based on the temperature sensed by the temperature sensing unit 700 and the predetermined temperature.

As described above, when the refrigerator doors are closed, the compressor 400 is operated with the turning on/off period. However, even if the refrigerant is leaked when the refrigerator doors 200 are closed, the compressor 400 is operated with the turning on/off period, and thereby, the refrigerant may be exploded due to electric spark generated when the electric devices in the refrigerator are turned on/off.

SUMMARY OF THE INVENTION

Therefore, an object of the present invention is to provide an apparatus and a method for controlling operation of compressor in a refrigerator which are able to prevent an explosion due to leakage of refrigerant by controlling power source supplied to electric devices in the refrigerator based on operating time of the compressor, when refrigerator doors are closed.

Another object of the present invention is to provide an apparatus and a method for controlling operation of a compressor in a refrigerator which are able to prevent an explosion due to leakage of refrigerant by controlling power source supplied to electric devices in the refrigerator based on inner temperature of the refrigerator when operating time of the compressor has passed a predetermined time.

To achieve the objects of the present invention, as embodied and broadly described herein, there is provided a method for controlling operation of a compressor in a refrigerator according to the present invention comprising: a step of supplying power source to a compressor in order to drive the compressor; a step of sensing opened/closed status of refrigerator doors continuously when the power source is supplied to the compressor; a step of comparing operating time of the compressor to a predetermined time when the refrigerator door is closed; and a step of blocking power source supplied to the compressor in order to suspend the operation of the compressor, when the operating time of the compressor is passed the predetermined time.

To achieve the another object of the present invention, there is provided a method for controlling operation of a compressor in a refrigerator comprising: a step of supplying power source to the compressor in order to drive the compressor; a step of measuring operating time of the compressor continuously when the power source is supplied to the compressor; a step of comparing inner temperature of the refrigerator to a predetermined temperature when the operating time of the compressor has passed a predetermined time; and a step of blocking power source supplied to the compressor in order to suspend the operation of the compressor when the inner temperature of the refrigerator is higher than that of the predetermined temperature.

There is also provided an apparatus for controlling operation of compressor in a refrigerator comprising: a door open sensing unit for sensing opened/closed status of a door in the refrigerator; a operating time measuring unit for measuring operating time of the compressor; a microcomputer for outputting a control signal based on the opened/closed status of the refrigerator door and the measured operating time; and a driving unit supplying or blocking power source to the compressor in order to control the compressor based on the control signal.

Also, there is provided an apparatus for controlling operation of compressor in a refrigerator comprising: a temperature sensing unit for sensing inner temperature of the refrigerator; an operating time measuring unit for measuring operating time of the compressor; a microcomputer outputting a control signal based on the inner temperature and the measured operating time; and a driving unit supplying or blocking power source to the compressor in order to control the compressor based on the control signal.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An apparatus and a method for controlling operation of a compressor in a refrigerator which are able to prevent an explosion due to a leakage of refrigerant by blocking power source supplied to electric devices in the refrigerator based on inner temperature of the refrigerator, opened/closed status of the refrigerator door, and operating time of the compressor will be described in detail with reference to FIGS. 3~5.

Figure 1:
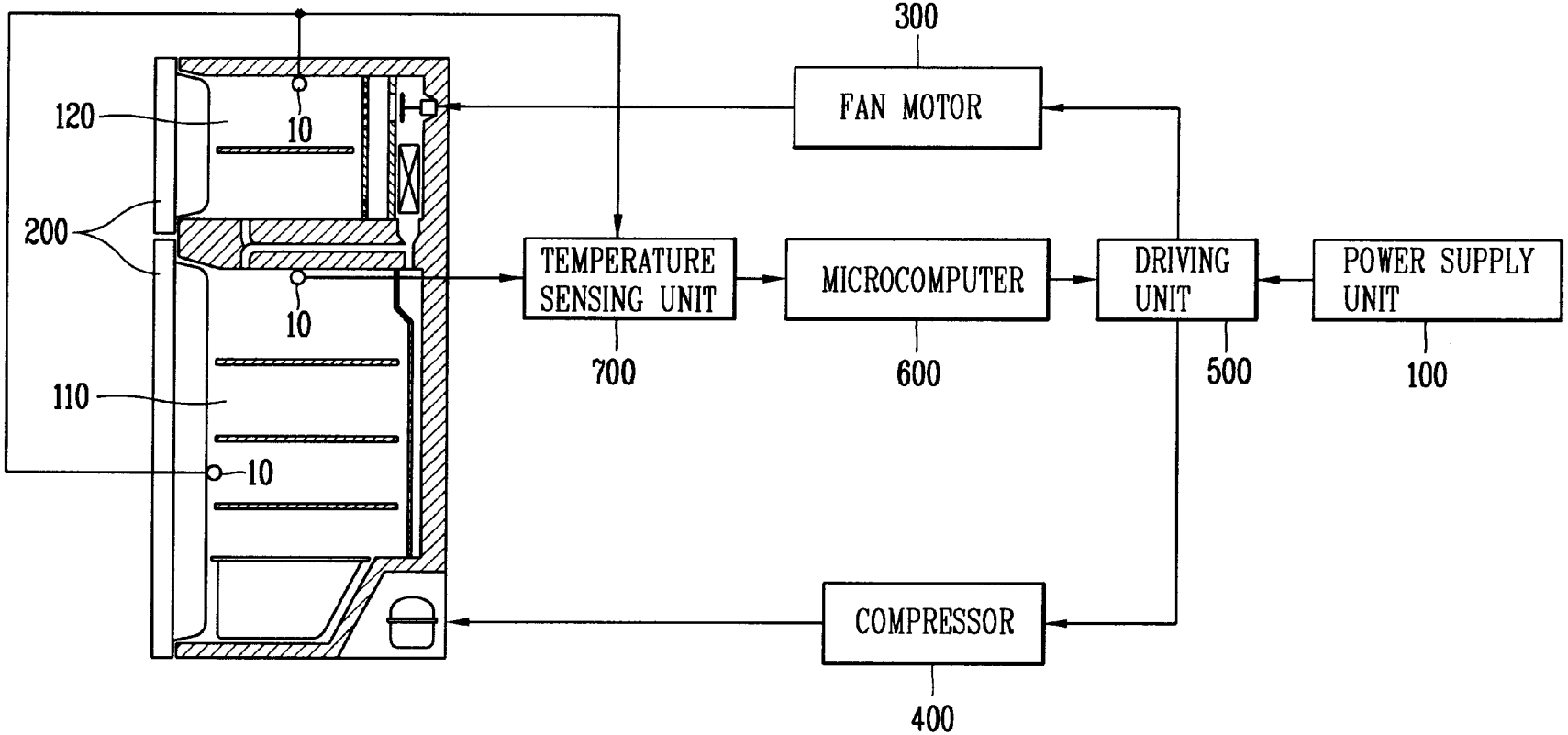
FIG. 1 CONVENTIONAL ART
FIG. 1 is a block diagram showing a brief structure of a general refrigerator.
Figure 2:
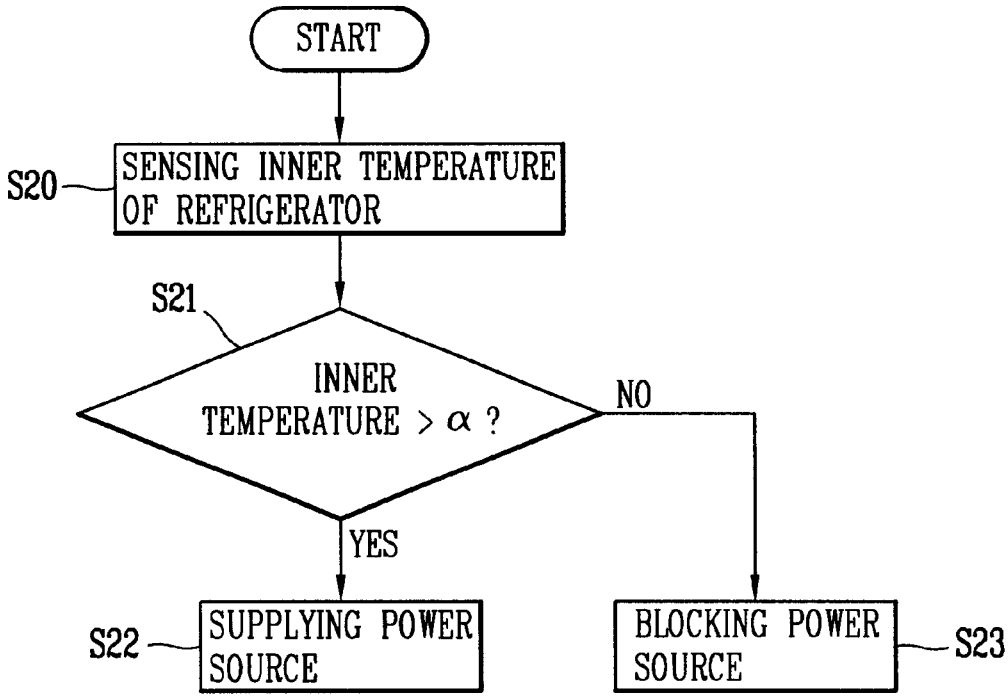
FIG. 2 CONVENTIONAL ART
FIG. 2 is an operational flow chart illustrating a method for controlling operation of a compressor in a refrigerator according to the conventional art.
Figure 3:
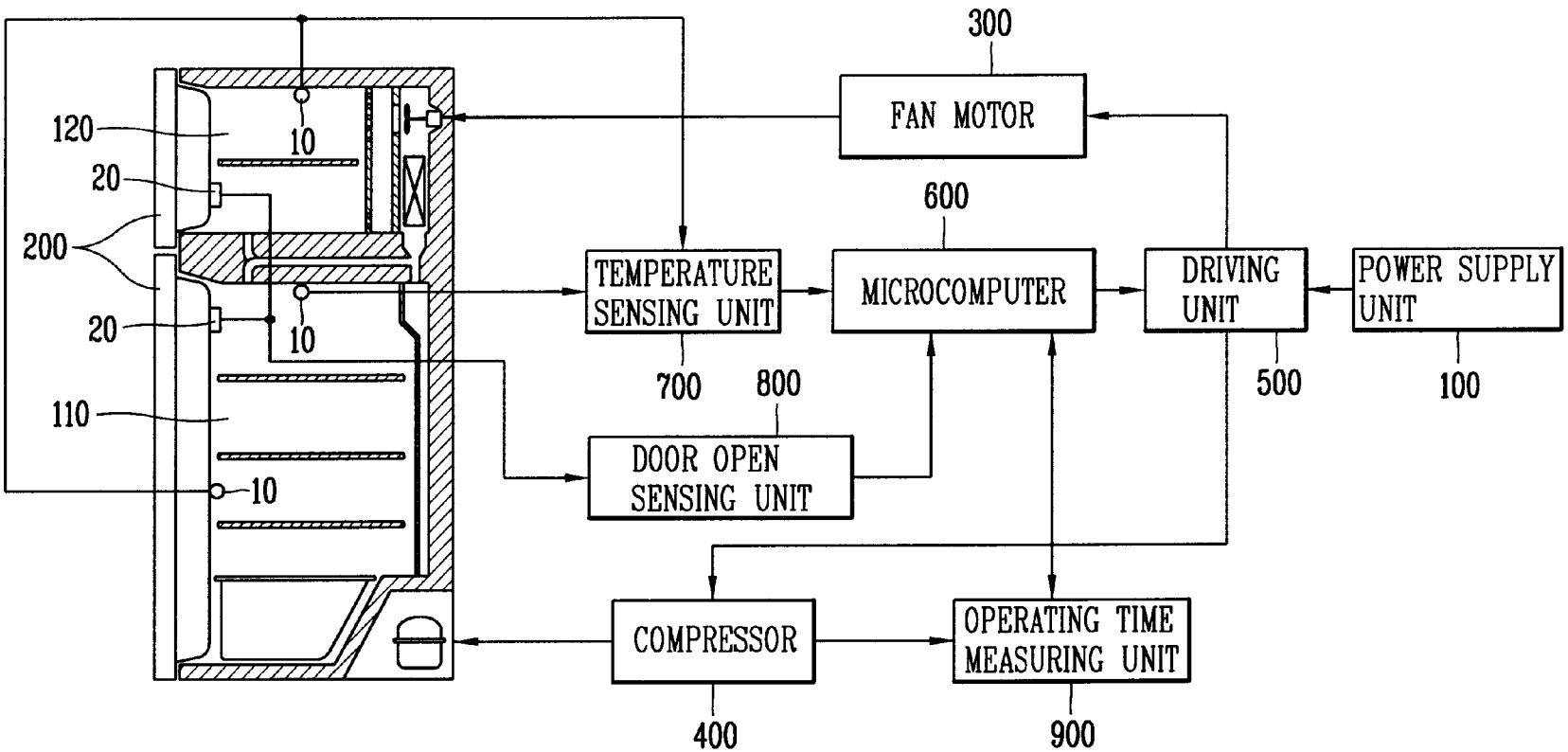
FIG. 3 is a block diagram showing a brief structure of a refrigerator according to the present invention.

FIG. 3 is a block diagram showing a brief structure of a refrigerator according to the present invention.

As shown therein, a refrigerator according to the present invention comprises: a power source unit 100 for supplying power source to the refrigerator; a cooling chamber 110 storing foods in a low temperature; a freezing chamber 120 for storing foods in frozen status; refrigerator doors 200 installed on front surfaces of the cooling chamber 110 and the freezing chamber 120 and used when a user stores foods or draws the stored foods; a temperature sensing unit 700 for sensing inner temperatures of the cooling chamber 110 and the freezing chamber 120; a door open sensing unit 800 sensing opened/closed status of the door using a door switch 20; an operating time measuring unit 900 for measuring operating time of the compressor; a microcomputer 600 outputting a control signal based on the opened/closed status of the refrigerator door and the measured operating time; a compressor generating cool air; and a driving unit 500 supplying or blocking the power source to the compressor 400 based on the control signal outputted from the microcomputer 600 in order to control a fan motor 300 and the compressor 400.

Figure 4:
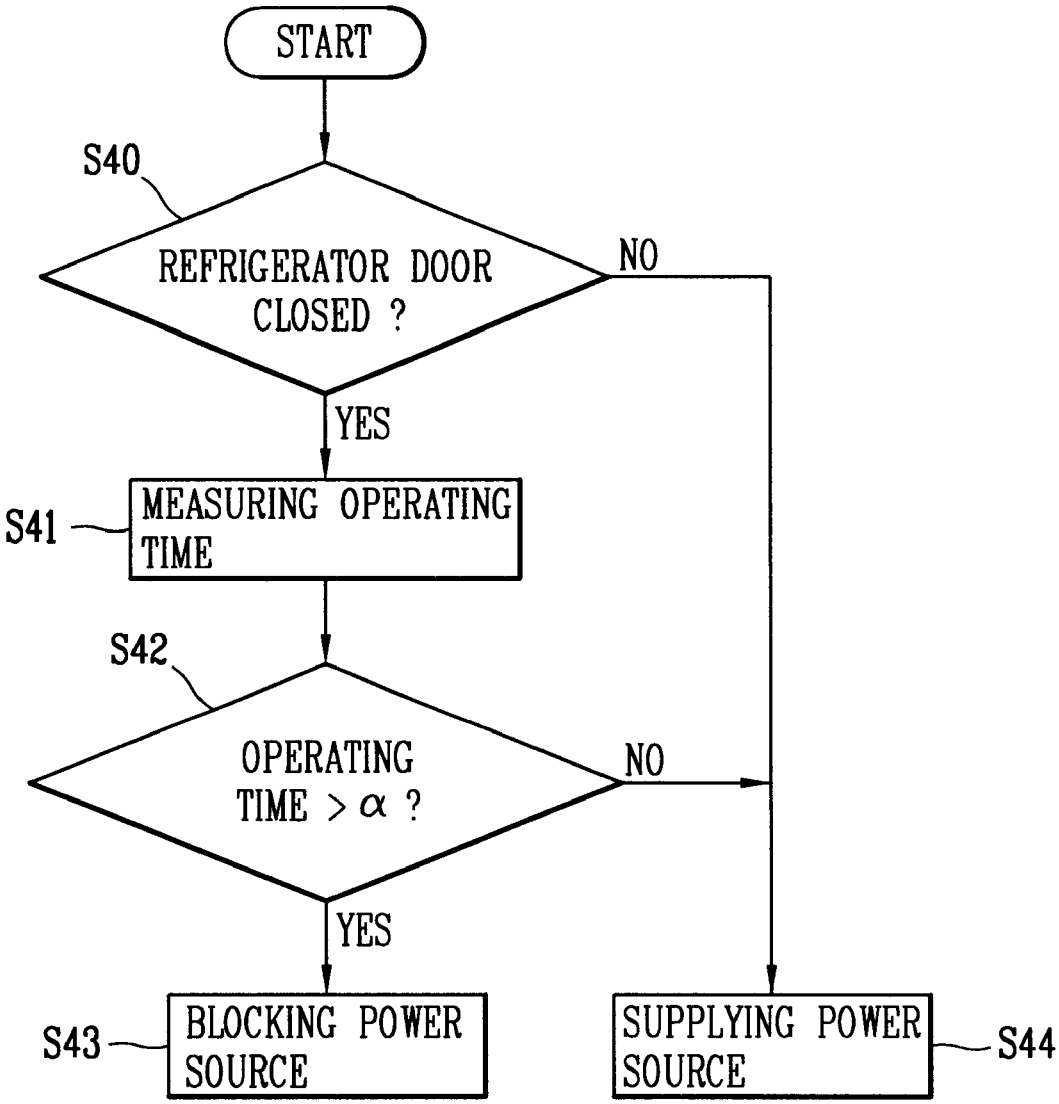
FIG. 4 is an operational flow chart illustrating a method for controlling operation of a compressor in a refrigerator according to a first embodiment of the present invention.

FIG. 4 is an operational flow chart illustrating the operation controlling method for the compressor in the refrigerator according to the first embodiment of the present invention.

As shown therein, the method for controlling operation of compressor in the refrigerator comprises: a step of sensing whether or not the refrigerator door 200 is closed (S40); a step of measuring operating time of the compressor 400 when the refrigerator door is closed (S41); a step of comparing the operating time of the compressor 400 to a predetermined time (S42); a step of blocking the power source 100 supplied to the compressor 400 in order to suspend the operation of the compressor 400 when the operating time of the compressor 400 is passed after the predetermined time (S43); and a step of supplying the power source to the compressor 400 in order to drive the compressor 400 when the operating time of the compressor is within the predetermined time (S44).

The operation controlling method according to the present invention will be described in detail as follows. To begin with, when the user selects operational mode of the compressor, the door open sensing unit 800 senses the opened/closed status of the door continuously, and outputs a sensed signal to the microcomputer 600 when the opened/closed status of the refrigerator door is changed (S40).

The operating time measuring unit 900 measures the operating time of the compressor 400, and outputs the measured operating time information to the microcomputer 600 (S41).

The microcomputer 600 outputs a control signal to the driving unit 500 based on the signal sensed by the door open sensing unit and the operating time information measured by the operating time measuring unit. Herein, the microcomputer 600 outputs a first control signal for driving the compressor 400 to the driving unit 500 when the refrigerator door 200 is opened. On the contrary, the microcomputer 600 compares the operating time of the compressor to the predetermined time when the refrigerator door 200 is closed. Herein, when the operating time of the compressor 400 is within the predetermined time, the microcomputer 600 outputs the first control signal for supplying the power source to the compressor 400 to the driving unit 500. And when the operating time of the compressor is passed the predetermined time, the microcomputer 600 outputs a second control signal for blocking the power source 100 supplied to the compressor to the driving unit 500 when the operating time of the compressor 400 is passed the predetermined time (S42).

The driving unit 500 supplies or blocks the power source to the compressor 400 in order to control the compressor 400 based on the first and second control signals outputted from the microcomputer 600. Herein, the driving unit 500 supplies the power source to the compressor 400 in order to drive the compressor 400, when the driving unit 500 receives the first control signal (S44). On the contrary, the driving unit 500 blocks the power source supplied to the compressor 400 in order to suspend the compressor 400 when the driving unit 500 receives the second control signal (S43).

Therefore, when the refrigerator door 200 is in the closed status and the compressor 400 is operated continuously, the microcomputer 600 compares the measured operating time to the predetermined time. At that time, the microcomputer 600 decides that the refrigerant of the refrigerator is leaked when the measured operating time is passed the predetermined time, and outputs the second control signal to the driving unit 500. The driving unit 500 blocks the power source 100 supplied to the compressor 400 in order to suspend the operation of the compressor 400 based on the outputted second control signal, and thereby, the explosion of refrigerant caused by electric spark generated when the electric devices in the refrigerator are turned on/off can be prevented. At that time, it is desirable that the driving unit 500 blocks the power source supplied to all electric devices in the refrigerator in order to prevent the electric spark from generating when the electric devices are turned on/off.

Also, result of operating control experiment of an actual refrigerator compressor is shown as follows. When the refrigerator door 200 is closed and the refrigerant is leaked, the compressor 400 is continuously operated. At that time, when the operating time of the compressor 400 measured by the operating time measuring unit 900 passes two hours, the driving unit 500 blocks the power source supplied to all electric devices in the refrigerator. Therefore, the electric spark which is generated by turning on/off the electric devices in the refrigerator can be prevented, and therefore, the explosion of the refrigerant can be prevented. Herein, the R600a is used as the refrigerant.

Figure 5:
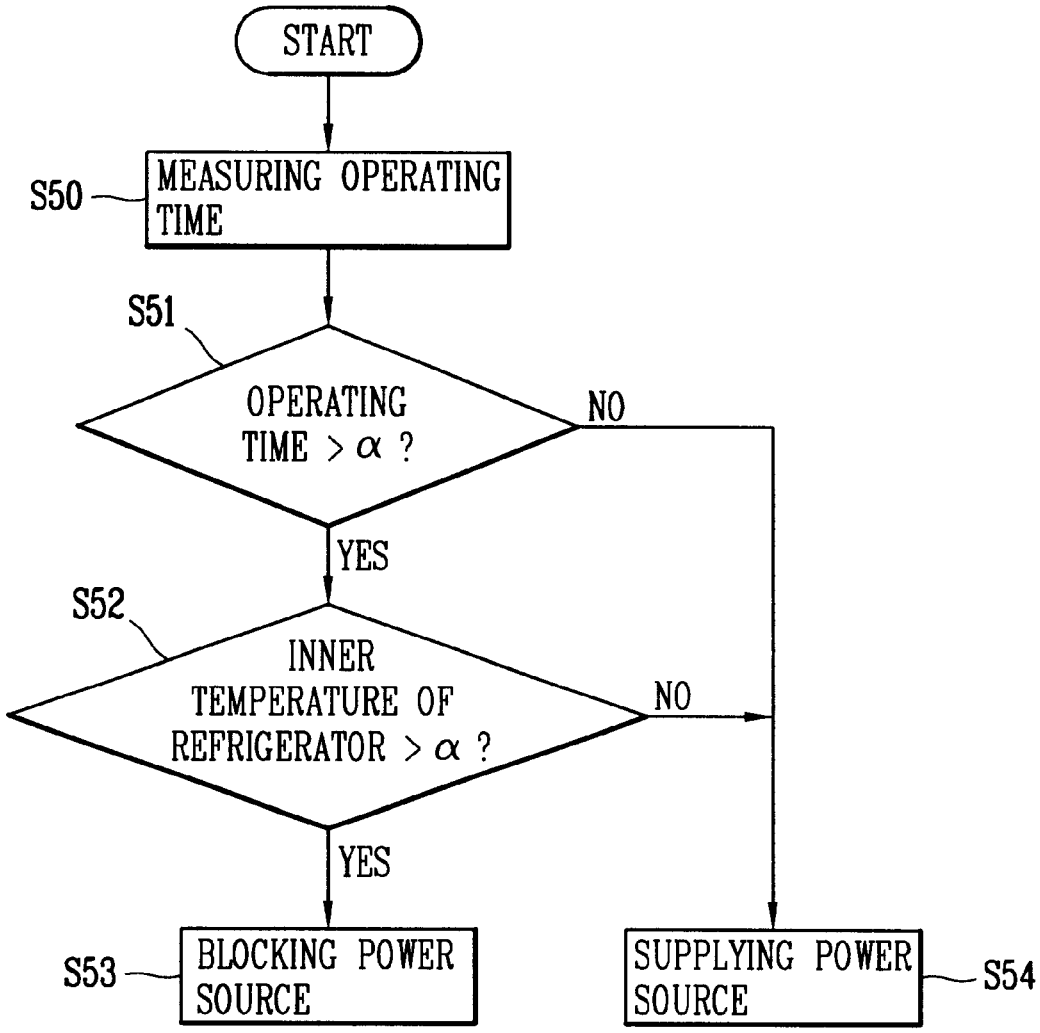
FIG. 5 is an operational flow chart illustrating a method for controlling operation of a compressor in a refrigerator according to a second embodiment of the present invention.

FIG. 5 is an operational flow chart illustrating a method for controlling operation of compressor in the refrigerator according to the second embodiment of the present invention.

As shown in FIG. 5, the method for controlling operation of the compressor in the refrigerator according to the present invention comprises: a step of measuring operating time of the compressor 400 (S50); a step of comparing the measured operating time of the compressor to a predetermined time (S51); a step of comparing inner temperature in the refrigerator to a predetermined temperature when the operating time of the compressor passes the predetermined time (S52); a step of blocking power source supplied to the compressor in order to suspend the operation of compressor when the inner temperature of the refrigerator is higher than the predetermined temperature (S53); and a step of supplying power source to the compressor in order to drive the compressor when the inner temperature of the refrigerator is lower than the predetermined temperature (S54), in deciding leakage of refrigerant based on the inner temperature of the refrigerator when the operating time of the compressor passes the predetermined time.

The operation controlling method according to the present invention will be described in detail as follows. To begin with, when the user selects the operational mode of the refrigerator, the operating time measuring unit 900 measures the operating time of the compressor continuously and outputs the measured operating time information to the microcomputer 600 (S50).

The microcomputer 600 outputs the control signal to the driving unit 500 based on the operating time measured by the operating time measuring unit 900 and the predetermined time. Herein, the microcomputer 600 outputs the first control signal for driving the compressor 400 to the driving unit 500 when the operating time passes the predetermined time. On the contrary, the microcomputer 600 compares the inner temperature of the refrigerator to the predetermined temperature when the operating time passes the predetermined time. When the inner temperature of the refrigerator is lower than the predetermined temperature, the microcomputer 600 outputs the first control signal for supplying the power source into the compressor 400 to the driving unit 500, and when the inner temperature of the refrigerator is higher than the predetermined temperature, the microcomputer 600 outputs the second control signal for blocking the power source supplied to the compressor 400 to the driving unit 500.

The driving unit 500 supplies or blocks the power source to the compressor 400 in order to control the compressor 400 based on the first and second control signals outputted from the microcomputer 600. Herein, the driving unit 500 supplies the power source to the compressor 400 for driving the compressor 4000 when the driving unit 500 receives the first control signal. On the contrary, the driving unit 500 blocks the power source supplied to the compressor 400 in order to suspend the compressor 400 when the driving unit 500 receives the second control signal.

Therefore, when the operating time of the compressor 400 passes the predetermined time and the compressor 400 is operated continuously, the microcomputer 600 compares the sensed inner temperature to the predetermined temperature. At that time, the microcomputer 600 decides that the refrigerant of the refrigerator is leaked when the inner temperature of the refrigerator is higher than the predetermined temperature, and outputs the second control signal to the driving unit 500. The driving unit 500 blocks the power source supplied to the compressor 400 in order to suspend the operation of the compressor 400 based on the outputted second control signal, and thereby, the explosion of refrigerant by the electric spark generated when the electric devices in the refrigerator are turned on/off can be prevented. At that time, it is desirable that the driving unit 500 blocks the power source supplied to all electric devices in the refrigerator in order to prevent the electric spark from generating when the electric devices in the refrigerator are turned on/off.

As described above, according to the apparatus and the method for controlling operation of the compressor in the refrigerator of the present invention, in deciding whether or not the refrigerant is leaked based on the operating time of the compressor in the state that the refrigerator door is closed, when the refrigerator door 200 is closed and the compressor 400 is operated continuously, or when the operating time of the compressor 400 passes the predetermined time and the inner temperature of the refrigerator is higher than the predetermined temperature, the microcomputer 600 decides that the refrigerant is leaked and outputs the second control signal to the driving unit 500. In addition, the driving unit 500 blocks the power source 100 supplied to the all electric devices in the refrigerator based on the second control signal, and therefore, the electric spark is not generated and the explosion of refrigerant can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling operation of a compressor in a refrigerator, comprising:

a sensor configured to sense an opened/closed status of a door of the refrigerator and to output a corresponding signal;

a timer configured to measure an operating time of a compressor of the refrigerator and to output a corresponding signal;

a controller configured to receive the signals output by the sensor and the timer, to compare the signal output by the timer to a preset value, and to output at least one control signal based on the signal output by the sensor and the comparison conducted; and a driver configured to receive the at least one control signal output by the controller, and to supply or to block power to a plurality of electric devices of the refrigerator based on the control signal output by the controller.

2. The apparatus of claim 1, wherein the driver supplies or blocks power to the compressor based on the at least one control signal.

3. The apparatus of claim 1, wherein the at least one control signal output by the controller comprises at least:

a first signal to the driver to supply power to a plurality of electric devices of the refrigerator when either the sensor senses that the refrigerator door is opened, or when the sensor senses that the refrigerator door is closed and an operating time of the compressor while the door has remained closed, as measured by the timer, is within a predetermined range of time; and a second signal to the driver to block power to a plurality of electric devices of the refrigerator when the sensor senses that the refrigerator door is closed and an operating time of the compressor while the door has remained closed, as measured by the timer, exceeds an upper limit of a predetermined range of time.

4. The apparatus of claim 3, wherein the second control signal blocks power to the plurality of electric devices so as to prevent combustion of a refrigerant of the refrigerator which has leaked.

5. The apparatus of claim 3, wherein the predetermined range of time is less than or equal to two hours.

6. An apparatus for controlling operation of a compressor in a refrigerator, comprising:

a temperature sensor configured to sense an inner temperature of the refrigerator and to output a corresponding temperature signal;

a timer configured to measure an operating time of a compressor in the refrigerator and to output a corresponding time signal;

a controller configured to receive the signals output by the temperature sensor and the timer, to compare the signal output by the temperature sensor to a first preset value, to compare the time signal output by the timer to a second preset value, and to output at least one control signal based on the comparisons conducted; and a driver configured to receive the at least one control signal output by the controller, and to supply or to block power to a plurality of electric devices of the refrigerator based on the control signal output by the controller.

7. The apparatus of claim 6, wherein the at least one control signal output by the controller comprises at least:

a first signal to the driver to supply power to a plurality of electric devices of the refrigerator when either an operating time of the compressor measured by the timer is within a predetermined range of time, or, when an operating time of the compressor measured by the timer exceeds an upper limit of a predetermined range of time and an inner temperature of the refrigerator measured by the sensor is lower than a predetermined temperature; and a second signal to the driver to block power to a plurality of electric devices of the refrigerator when an operating time of the compressor measured by the timer exceeds an upper limit of a predetermined range of time and an inner temperature of the refrigerator sensed by the temperature sensor exceeds the predetermined temperature.

8. The apparatus of claim 6, wherein the driver is configured to supply or block power to a compressor of the refrigerator.

9. The apparatus of claim 7, wherein the second control signal blocks power to the plurality of electric devices so as to prevent combustion of a refrigerant of the refrigerator which has leaked.

10. The apparatus of claim 7, wherein the timer is configured to measure the amount of time that the compressor has continuously operated while the refrigerator door has remained closed.

11. The apparatus of claim 7, wherein the predetermined range of time is less than or equal to two hours.

12. A method for controlling operation of a compressor in a refrigerators comprising:

sensing an opened/closed status of a refrigerator door;

measuring an operating time of a compressor in the refrigerator when the refrigerator door is closed;

comparing the measured operating time of the compressor to a predetermined range of time;

blocking a power supply to the compressor in order to suspend operation of the compressor when the measured operating time of the compressor exceeds an upper limit of the predetermined range of time and the door is closed; and supplying power to the compressor in order to drive the compressor when the measured operating time of the compressor is within the predetermined range of time and the door is closed.

13. The method of claim 12, wherein the supplying step further comprises supplying power to the compressor when it is determined that the refrigerator door is opened.

14. The method of claim 12, wherein a refrigerant used in the refrigerator is R600a.

15. The method of claim 12, wherein the predetermined range of time is less than or equal to two hours.

16. The method of claim 12, wherein the power supply to the compressor is blocked so as to prevent combustion of a refrigerant of the refrigerator which has leaked.

17. The method of claim 12, wherein the measured operating time of the compressor comprises a continuous operating time.

18. A method for controlling operation of a compressor in a refrigerators comprising:

measuring an operating time of a compressor in the refrigerator;

comparing the measured operating time of the compressor to a predetermined range of time;

comparing an inner temperature of the refrigerator to a predetermined temperature range when the measured operating time of the compressor exceeds an upper limit of the predetermined range of time;

blocking power to the compressor in order to suspend the operation of the compressor when the result of the temperature comparision indicates that the inner temperature of the refrigerator exceeds an upper limit of the predetermined temperature range; and supplying power to the compressor in order to drive the compressor when the result of the temperature compression indicates that the inner temperature of the refrigerator is within the predetermined temperature range.

19. The method of claim 18, further comprising supplying power to the compressor when the measured operating time of the compressor is within the predetermined range of time.

20. The method of claim 18, wherein a refrigerant used in the refrigerator is R600a.

21. The method of claim 18, wherein the predetermined range of time is less than or equal to two hours.

22. The method of claim 18, wherein the power supply to the compressor is blocked so as to prevent combustion of a refrigerant of the refrigerator which has leaked.

23. The method of claim 18, wherein the measuring step comprises measuring an amount of time that the compressor has been continuously operating while a door of the refrigerator remains closed.

24. An apparatus which controls operation of a compressor in a refrigerator, comprising:

a door sensor configured to sense if a door of the refrigerator is opened or closed and to output a corresponding signal;

a timer configured to measure an operating time of a compressor installed in the refrigerator and to output a corresponding time signal;

a controller configured to receive the signals output by the door sensor and the timer, to compare the signal output by the timer to a preset time value, and to control a supply of power to the compressor based on the signal output by the door sensor and a result of the comparison conducted.

25. The apparatus of claim 24, further comprising a driver configured to receive a control signal output by the controller, and to supply or to block a flow of power to a plurality of electric devices of the refrigerator.

26. The apparatus of claim 25, wherein the controller is configured to output a first control signal to the driver to supply power to a plurality of electric devices of the refrigerator when either the refrigerator door is opened, or when the refrigerator door is closed and the amount of time that the compressor has been continuously operating while the door has remained closed, as measured by the timer, is within a predetermined range of time.

27. The apparatus of claim 26, wherein the controller is configured to output a second control signal to the driver to block the flow of power to a plurality of electric devices of the refrigerator when the refrigerator door is closed and the amount of time that the compressor has been continuously operating while the door remains closed, as measured by the timer, exceeds an upper limit of the predetermined range of time.

28. The apparatus of claim 27, wherein the second control signal blocks power to the plurality of electric devices so as to prevent combustion of a refrigerant of the refrigerator which has leaked.

29. An apparatus which controls operation of a compressor in a refrigerator, comprising:

a temperature sensor configured to sense an inner temperature of the refrigerator and to output a corresponding temperature signal;

a timer configured to measure an operating time of a compressor installed in the refrigerator and to output a corresponding time signal; and a controller configured to receive the signals output by the sensor and the timer, to compare the temperature signal output by the temperature sensor to a preset temperature value, to compare the time signal output by the timer to a preset time value, and to control a supply of power to the compressor based on results of the comparisons conducted.

30. The apparatus of claim 29, further comprising a driver configured to receive a control signal output by the controller, and to supply or to block a flow of power to a plurality of electric devices of the refrigerator.

31. The apparatus of claim 30, wherein the controller is configured to output a first control signal to the driver to supply power to a plurality of electric devices of the refrigerator when either an amount of time that the compressor has been continuously operating, as measured by the timer, is within a predetermined range of time, or when an amount of time that the compressor has been continuously operating, as measured by the timer, exceeds an upper limit of the predetermined range of time and an inner temperature of the refrigerator sensed by the temperature sensor is lower than the preset temperature value.

32. The apparatus of claim 31, wherein the controller is configured to output a second control signal to the driver to block the flow of power to a plurality of electric devices of the refrigerator when an amount of time that the compressor has been continuously operating, as measured by the timer, exceeds the upper limit of the predetermined range of time and an inner temperature of the refrigerator sensed by the sensor exceeds the preset temperature value.

33. The apparatus of claim 32, wherein the second control signal blocks power to the plurality of electric devices so as to prevent combustion of a refrigerant of the refrigerator which has leaked.

34. The apparatus of claim 31, wherein the amount of time that the compressor has been continuously operating comprises an amount of time that the compressor has been operating continuously while a door of the refrigerator remains closed.

* * * * *